US005799332A

United States Patent [19]

Goodwin

[11] Patent Number: 5,799,332

[45] Date of Patent: Sep. 1, 1998

[54] HAND COVERINGS

[75] Inventor: Brent I. Goodwin, Elkton, Md.

[73] Assignee: W. L. Gore & Associates, Inc., Newark, Del.

[21] Appl. No.: 837,833

[22] Filed: Apr. 22, 1997

Related U.S. Application Data

[60] Provisional application No. 60/035,712, Jan. 16, 1997.

[51] Int. Cl.[6] ..... A41D 25/00

[52] U.S. Cl. ..... 2/159; 2/158

[58] Field of Search ..... 2/158, 159, 169, 2/161.6, 164, 161.7, 161, 163, 167–168

[56] References Cited

U.S. PATENT DOCUMENTS

| | | |
|---|---|---|
| 3,869,726 | 3/1975 | Bell . |
| 4,042,977 | 8/1977 | Antonious . |
| 4,189,787 | 2/1980 | Stansbury . |
| 4,245,357 | 1/1981 | Connelly . |
| 4,594,736 | 6/1986 | Connelly . |
| 4,643,791 | 2/1987 | Jurrius et al. . |
| 4,752,973 | 6/1988 | Wolfberg et al. . |
| 4,833,733 | 5/1989 | Welch et al. . |
| 4,850,053 | 7/1989 | Tepley et al. . |
| 5,167,038 | 12/1992 | Rinehart . |
| 5,169,251 | 12/1992 | Davis . |
| 5,560,044 | 10/1996 | Masley . |
| 5,566,405 | 10/1996 | Masley . |

FOREIGN PATENT DOCUMENTS

| | | |
|---|---|---|
| 514 912 | 3/1921 | France . |
| 2 032 024 | 11/1970 | France . |
| 1 256 236 | 12/1971 | United Kingdom . |
| 89/080995 | 10/1989 | WIPO . |

*Primary Examiner*—Gloria M. Hale
*Attorney, Agent, or Firm*—Gary A. Samuels

[57] ABSTRACT

In this invention a novel configuration of the crotch area between the thumb and first finger has been found to impart unexpectedly good durability and resistance to splitting of the seam in this crotch area. The configuration is one in which the geometry of the crotch area is formed by two arcs separated by a short substantially straight portion, and in which the radii loci of the two arcs is centered in the space between the thumb and first finger.

2 Claims, 2 Drawing Sheets

HAND COVERINGS

CROSS-REFERENCE TO RELATED APPLICATIONS

This application is based on Provisional Application Ser. No. 60/035,712, filed Jan. 16, 1997.

FIELD OF THE INVENTION

This invention relates to hand coverings having improved durability and resistance to splitting along seam areas between the thumb and index finger.

BACKGROUND OF THE INVENTION

It has been a problem in hand covering constructions that in uses in which the thumb is flexed frequently, the seam in the crotch area between the thumb and first index finger fails.

In typical glove constructions, the crotch area between the thumb and index finger comprises a curved area having an arc defined by a single radius with its loci at P as shown in FIG. 1 and as shown in U.S. Pat. Nos. 5,566,405 and 5,560,044 to Masley.

Alternatively, said crotch area is defined by two arcs each of which have the radii loci centered over near the crotch of the third and fourth finger (see $P_1$ and $P_2$ in FIG. 2).

SUMMARY OF THE INVENTION

In this invention a novel configuration of the crotch area between the thumb and first finger has been found to impart unexpectedly good durability and resistance to splitting of the seam in this crotch area. The configuration is one in which the geometry of the crotch area is formed by two arcs separated by a short substantially straight portion, and in which the radii loci of the two arcs is centered in the space between the thumb and first finger.

DETAILED DESCRIPTION OF THE INVENTION

Figure 2:
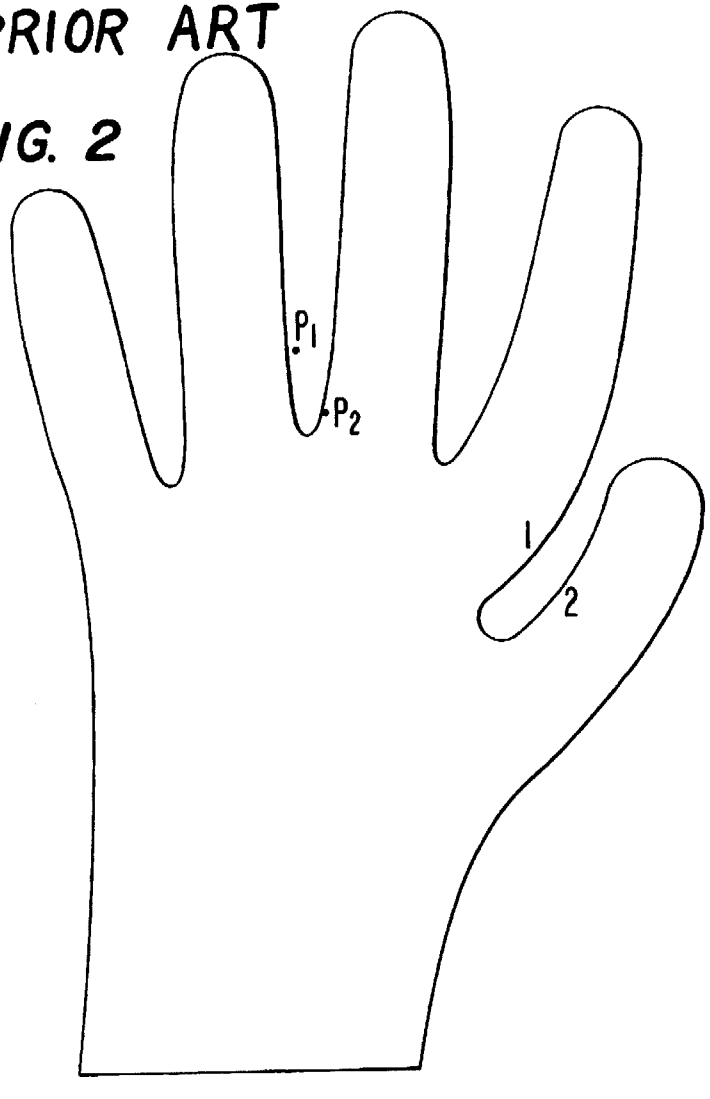
PRIOR ART FIG. 2
FIG. 2 depicts another prior art glove.
Figure 1:
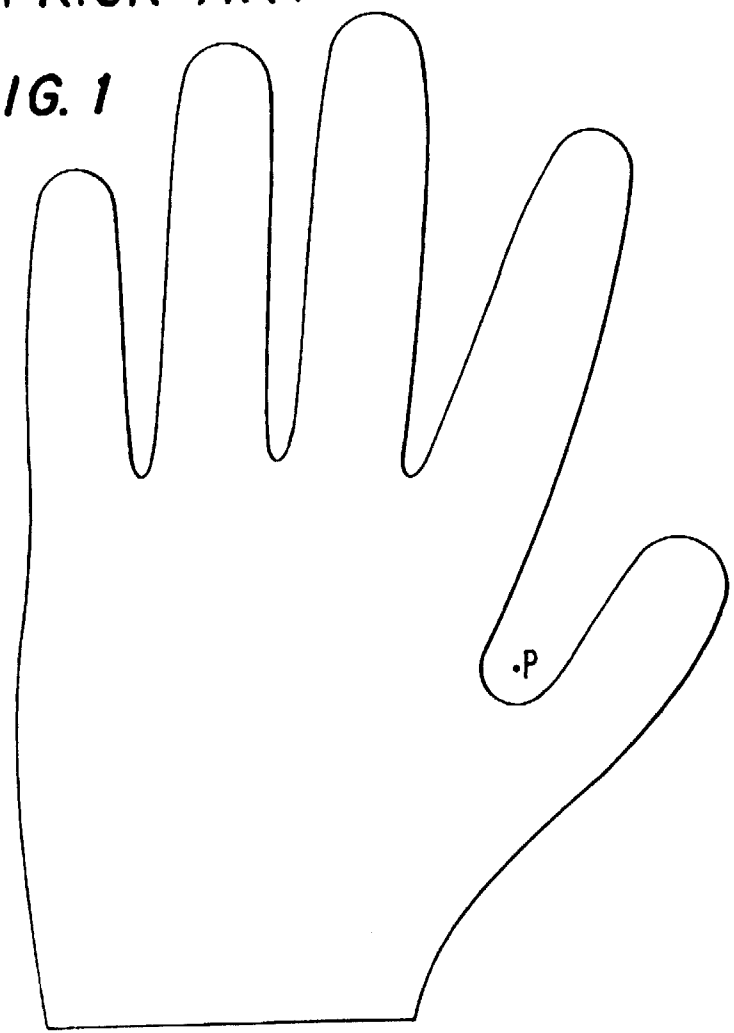
PRIOR ART FIG. 1
FIG. 1 depicts one prior art glove.
Figure 3:
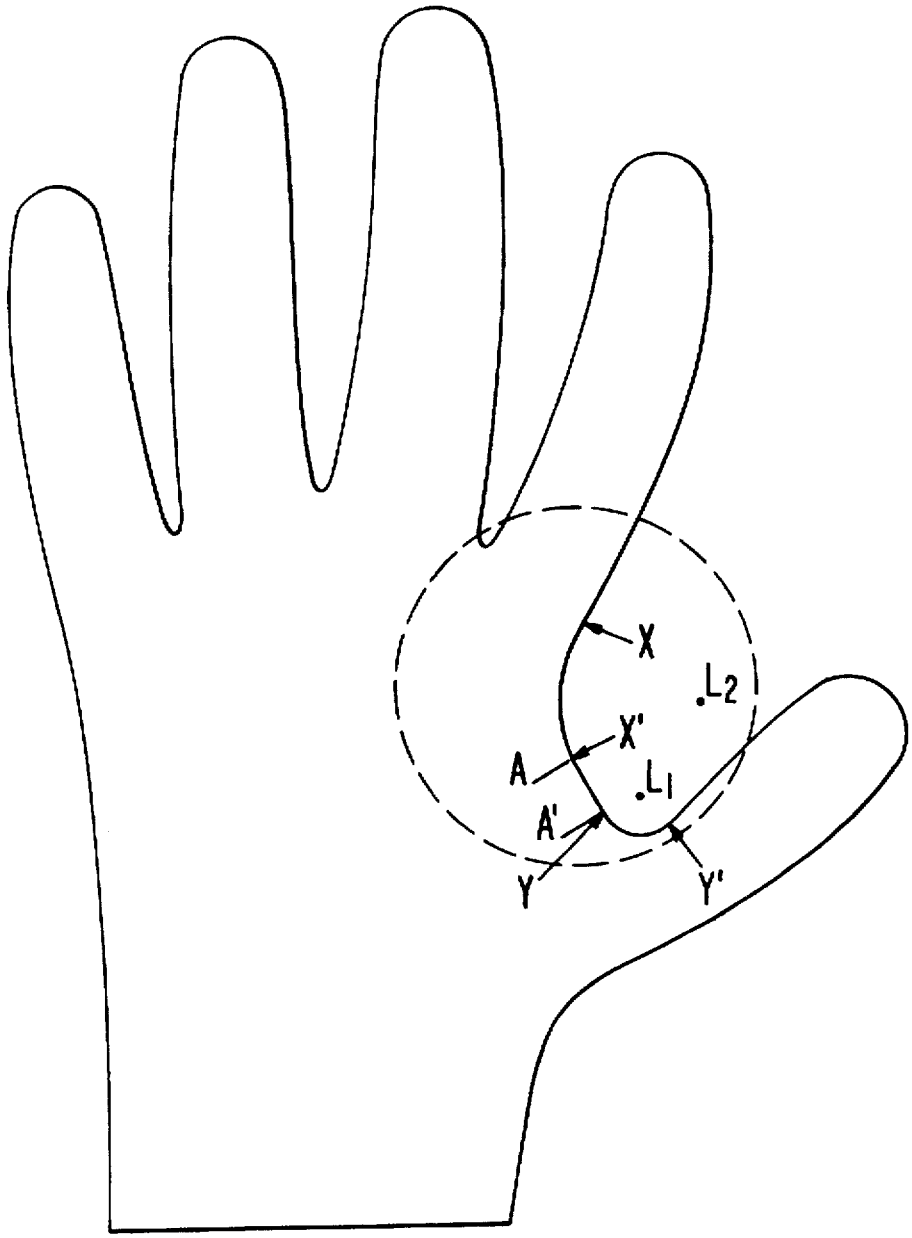
FIG. 3 depicts a glove of the invention.

The configuration of the glove of the invention is shown in FIG. 3. It is seen that the crotch area, i.e. the area within the dotted circle is configured so as to define an arc $X–X^1$ having the center of a circle defined by the arc located at $L_2$. It is seen that an arc $Y–Y^1$ defines a portion of a circle having its center located at $L_1$. It is also seen that the two arcs are separated by a substantially straight portion $A–A^1$ between the two arcs. It is understood that in portion A–A', by substantially straight is meant that the portion can be slightly curved if the radius of the arc so formed is a number of times greater than the radii of the arcs X–X' or Y'Y', e.g., at least 10 times or 50 or 100 times greater.

It has been found that when gloves are made by adhering two overlying cut-out patterns along the periphery by heat sealing, by sewing or by use of an adhesive, and when the crotch area is configured as described above, the glove has good durability and resistance to splitting in said crotch area.

Alternatively, the gloves can be made by dipping a glove form with the inventive crotch configuration in a dispersion or latex to make a three-dimensional glove. The use of two separated radii, each being located in close proximity to the hands' natural flex points, greatly reduces the buildup of stress in the glove seams as the hand is flexed. This becomes particularly important when the extensibility of the glove material is low or the modulus is high which creates high stress on the seam in that crotch area of the single radius glove. This high stress will lead to premature failure of the seam in the crotch area, and limits the commercial value of such a product.

The hand covering can be an outer glove or mitten, or can be a liner designed to fit under an outer glove or mitten. It can also be a surgical-type glove, or similar glove, i.e., one that provides a protective barrier to fluids.

The two patterns can be made of any material commonly found in hand covering applications. These include coverings made of rubber, latex, plastic, fabric knits, wovens, non-wovens, or laminates of these materials, and the like. The hand covering materials can include layers that impart insulative properties or waterproofness and which pass water vapor, such as microporous plastic films or membranes or foams. Examples are microporous polyolefins, microporous fluoropolymers such as microporous polytetrafluoroethylene, hydrophilic polyurethanes or polyetheresters, polyacrylates, polyamides, and the like.

For materials that are thermoplastic or thermosettable, the two patterns can simply be heated around the periphery (wrist area excluded, of course) to weld the two patterns together. Alternatively, an adhesive bead can be applied around the periphery.

Tests have shown when a glove construction follows a pattern where the 'V' crotch between the thumb and first finger is shaped very similar to the 'V' crotch between any of the other fingers and is formed by a single radius, the construction resulted in splitting of the glove seams at the thumb crotch. This invention overcomes the splitting problem.

Glove patterns can be sealed together using heat, radio-frequency, ultrasonic means, thermo impulse techniques, induction techniques or laser means.

EXAMPLE

A glove was constructed from a two layer laminate of expanded polytetrafluoroethylene and a polyether-polyester nonwoven fabric made in accordance with the teachings of U.S. Pat. No. 5,036,551. Lamination was achieved utilizing a continuous layer of polyurethane adhesive. Shapes of a glove were cut from the laminate and heat sealed together to form a glove having the crotch configuration of the invention. Strength of the crotch area was good.

I claim:

1. A hand covering that has a thumb and a portion for the first index finger and that has a crotch area between said thumb and said portion in which the geometry of the crotch area is formed by two arcs separated by a short substantially straight portion and in which the radii loci of the two arcs is centered in the space between the thumb and said portion.

2. The hand covering of claim 1 in the form of a mitten, a glove or a liner.

* * * * *